US005718551A

United States Patent [19]

Ebstein

[11] Patent Number: 5,718,551

[45] Date of Patent: Feb. 17, 1998

[54] AUTOMATIC MECHANIZED SYSTEM FOR THE STORAGE OF OBJECTS

[76] Inventor: Simon Ebstein, 44 chemin St Pierre, 31170 Tournefeuille, France

[21] Appl. No.: 615,252

[22] PCT Filed: Sep. 8, 1994

[86] PCT No.: PCT/FR94/01057

§ 371 Date: Mar. 13, 1996

§ 102(e) Date: Mar. 13, 1996

[87] PCT Pub. No.: WO95/08037

PCT Pub. Date: Mar. 23, 1995

[30] Foreign Application Priority Data

Sep. 15, 1994 [FR] France ..... 93 11189

[51] Int. Cl.[6] ..... E04H 006/18

[52] U.S. Cl. ..... 414/254; 414/240; 414/273; 414/264; 414/281; 414/252; 364/478.02

[58] Field of Search ..... 414/233, 234, 414/236, 237, 239, 240, 253, 254, 255, 231, 256, 261, 262, 268, 264, 273, 281, 252; 364/478.02

[56] References Cited

U.S. PATENT DOCUMENTS

| | | | |
|---|---|---|---|
| 3,161,302 | 12/1964 | Burrows | 414/254 |
| 3,570,687 | 3/1971 | Toedtli | 414/239 |
| 5,116,182 | 5/1992 | Lin | 414/254 |
| 5,425,612 | 6/1995 | Ebstein | 414/254 |

FOREIGN PATENT DOCUMENTS

| | | | |
|---|---|---|---|
| 1566540 | 9/1969 | France . | |
| 2670237 | 12/1992 | France . | |
| 2434371 | 2/1975 | Germany | 414/239 |
| 8715863 | 1/1988 | Germany . | |
| 118156 | 5/1993 | Japan | 414/240 |
| A709513 | 5/1954 | United Kingdom . | |
| 992238 | 5/1965 | United Kingdom | 414/264 |
| 9118162 | 11/1991 | WIPO | 414/254 |

*Primary Examiner*—Frank E. Werner

*Attorney, Agent, or Firm*—Ostrolenk, Faber, Gerb & Soffen, LLP

[57] ABSTRACT

Mechanized and fully automatically managed installation for the storage of objects, in particular motor vehicles or containers, including a central managing unit, at least one runway (14) or (16), storage cells (24), (26) distributed on each side of the runway and longitudinally orientated, at an angle of between 30° and 60° with the runway, at least one trolley (18), (22) comprising a wheeled frame fitted with an independent driving device and with guiding devices to enable the trolley to move along the runway and into the storage cells. The trolley includes a pivoting device, to be pivoted around the intersection point of the symmetry axis (16) of the runway and the symmetry axis (28) of the cell in which the motor vehicle has to be loaded or unloaded, so as to bring the guiding devices along said symmetry axis of the cell so the trolley can enter it and proceed with the loading or unloading of the vehicle.

10 Claims, 5 Drawing Sheets

AUTOMATIC MECHANIZED SYSTEM FOR THE STORAGE OF OBJECTS

TECHNICAL FIELD

This invention relates to a mechanized and automatically managed installation for storing objects such as motor vehicles or containers; it includes a self-propelling trolley for the transportation of the object along a runway with storage cells on each side of the runway, into which the trolley unloads the transported object.

STATE OF THE ART

There exists today numerous designs for automatically managed car parks in which motor vehicles are driverlessly conveyed from an entrance area to a storage cell, then delivered on request at an exit area where the owner repossesses his vehicle.

A detailed description of this technique is given in the French Patent N° 90/15547 which refers to a mechanized installation for storing motor vehicles, including a central managing unit, a closed circuit runway fitted with two longitudinal traffic alleys and storage cells distributed at an angle of 45° on either side of each traffic alley, the two rows of emplacements located between the alleys being juxtaposed.

A trolley mounted on a wheeled frame is fitted with self-propelling means, as well as guiding and switching means adapted to allow for its movement along the runway and its entry into the respective storage cells. The trolley is equipped with loading and unloading means enabling it to take hold of and put down an object when the trolley is positioned within a cell, these means being combined with two longitudinal, fixed racks opposite each other, each being made up of horizontal, fixed bars, parallel and at a distance from each other; these racks are arranged to delimit a free central zone between the ends of the fixed bars, the full installation being managed by the central unit, capable of directing the functioning of each trolley and the activating of the loading and unloading means.

Although the installation described above constitutes a considerable improvement compared to previous systems, as the self-propelling trolleys, moving easily due to the guiding means and the herring-bone disposition of the storage cells, result in a saving of parking bays in comparison to earlier systems, very short storage and removal cycles and a reduction of energy required, such an installation does not allow for the arrangement of an optimum number of vehicles in a given space, because it calls for a relatively wide runway permitting the rotation of the trolley when introduced into a cell to load or unload a vehicle.

SUMMARY OF THE INVENTION

This is why the main object of the invention is to achieve a mechanized installation for storing objects, with a maximum number of parking bays in relation to the surface area.

Another purpose of the invention is to achieve a mechanized installation for the storage of motor vehicles, in which the width of the runway required for the trolley transporting the vehicles is limited to the width of the trolley.

Consequently, the object of the invention is an automatically managed, mechanized installation for storing objects such as motor vehicles or containers, following the type described above in reference to the Patent N° 90/15547, in which, however, the storage cells form a longitudinal angle of between 30° and 60° with the runway and in which the trolley is fitted with a pivoting system enabling it to rotate, on the runway, around the point of intersection of the runway's symmetry axis and the symmetry axis of the cell into which the object must be loaded or unloaded, in order to bring the guiding elements of the trolley along the cell's symmetry axis, to enable the trolley to enter the cell and proceed with the loading or unloading of the object.

In accordance with another object of the invention, the pivoting means includes a vertical element which does not come into contact with the floor when the trolley moves, which can be lowered to bear on the floor at the intersection of the runway and the symmetry axis of the cell in which the object has to be loaded or unloaded and a driving means resulting in the rotation of the trolley around the pivoting element in order to bring the trolley's guiding elements along the cell's symmetry axis, to enable the trolley to enter and to proceed with the loading or unloading of the object.

BRIEF DESCRIPTION OF THE DRAWINGS

The objects and features of the invention will become clearer after reading the following description, referring to the drawings in which.

DETAILED DESCRIPTION OF THE INVENTION

Figure 1:
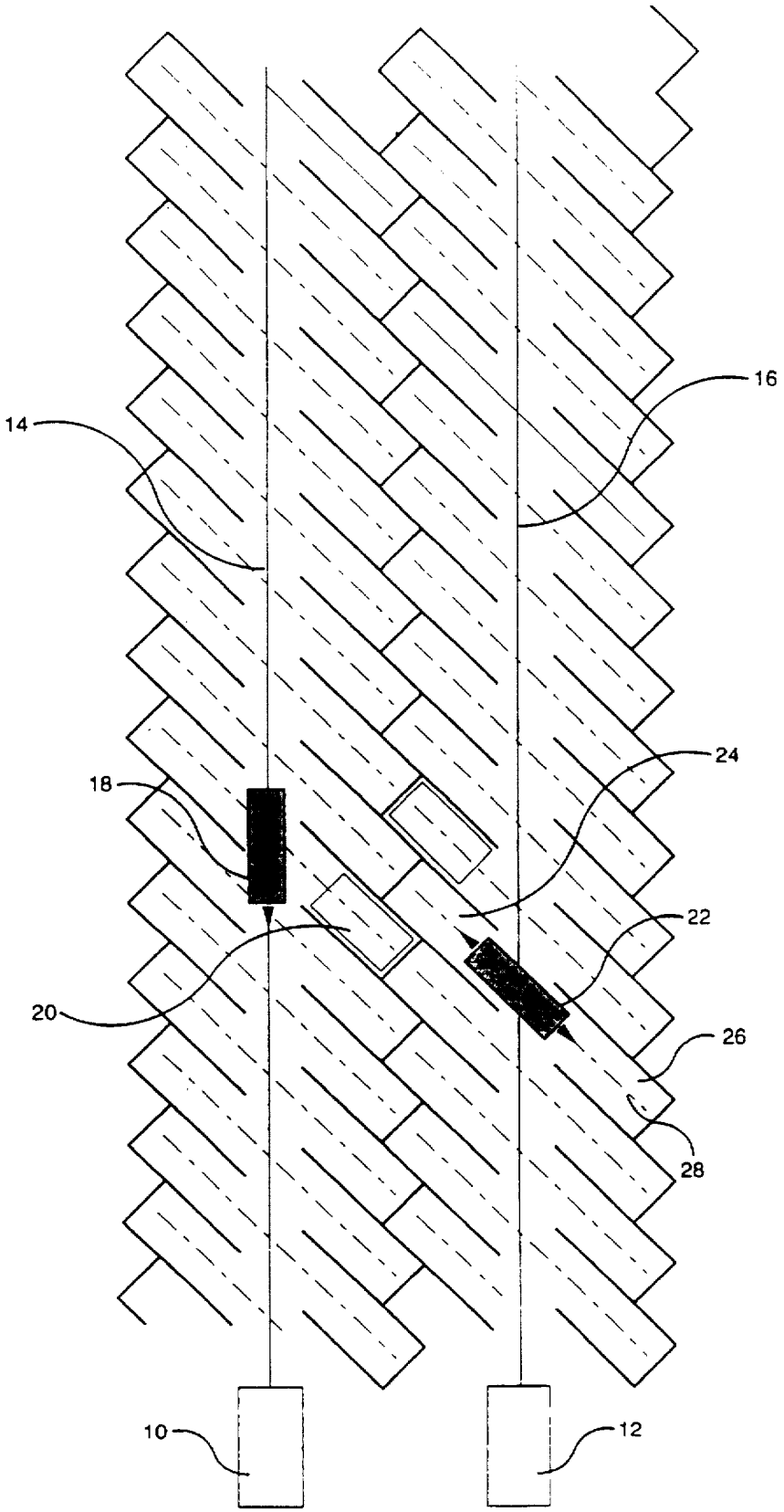
FIG. 1 schematically depicts a car park set up with the chosen implementation of the invention.

FIG. 1 depicts a car park implementing the invention. At the entrance to the car park, two hoists or elevators (10) and (12) are represented. Obviously, these elevators are mere entrance-exit locks when the car park has only one story. At the exit to each elevator (or lock), there is a runway represented by the guiding rail (14) or (16). On the first runway (14), a trolley (18) has just loaded a motor car raised (or lowered) by the lift (10) or has just unloaded a motor car in one of the storage cells forming an angle of 45° with the runway, for example the cell (20) depicted on the figure as containing a vehicle.

The second runway represented by the guiding rail (16) is also fitted with a transportation trolley. This trolley (22) has been shown in its loading or unloading position in one of the two storage cells (24) or (26). As in the case of trolley (18), trolley (20) moves thanks to a guiding rail. When it arrives in front of the cell (24) or (26), i.e. when the centre of the trolley which is mounted with a pivoting element is located at the intersection of the runway's guiding rail (16) and the guiding rail (28) along the cell's symmetry axis [forming an angle of 45° with the runway (16)], the trolley is compelled to swivel by means of the pivoting element bearing on the floor. When the slowing motion is completed, the trolley is in the position depicted in the figure where it is directed along the guiding rail (28). It is then activated to enter the storage cell (24) or (26), in order to proceed with the loading or unloading of a motor car.

Figure 2:
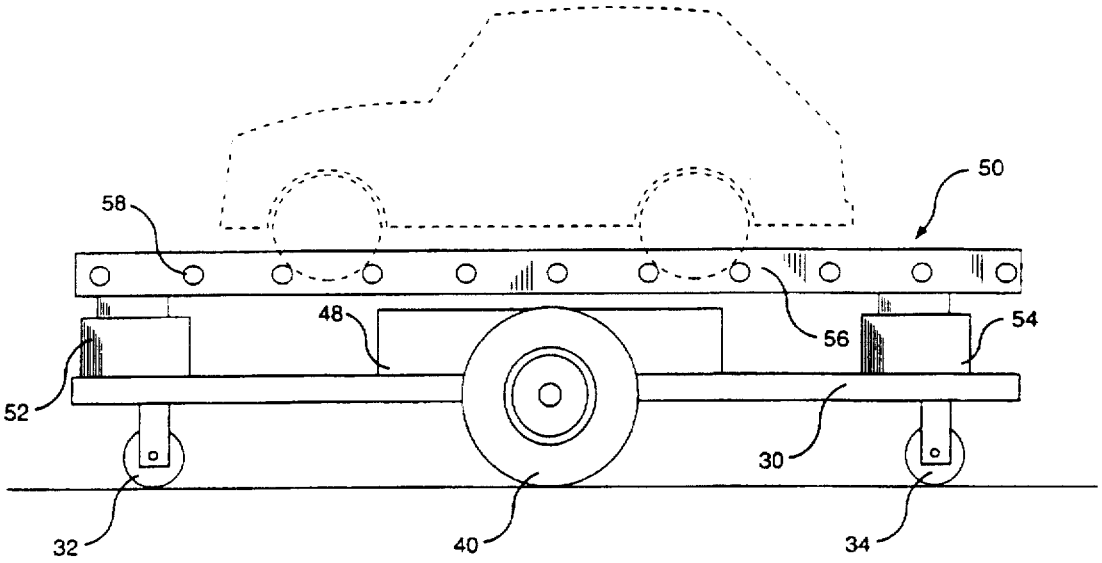
FIG. 2 represents the side view of a trolley equipped with the installation of this invention transporting a motor car.
Figure 3:
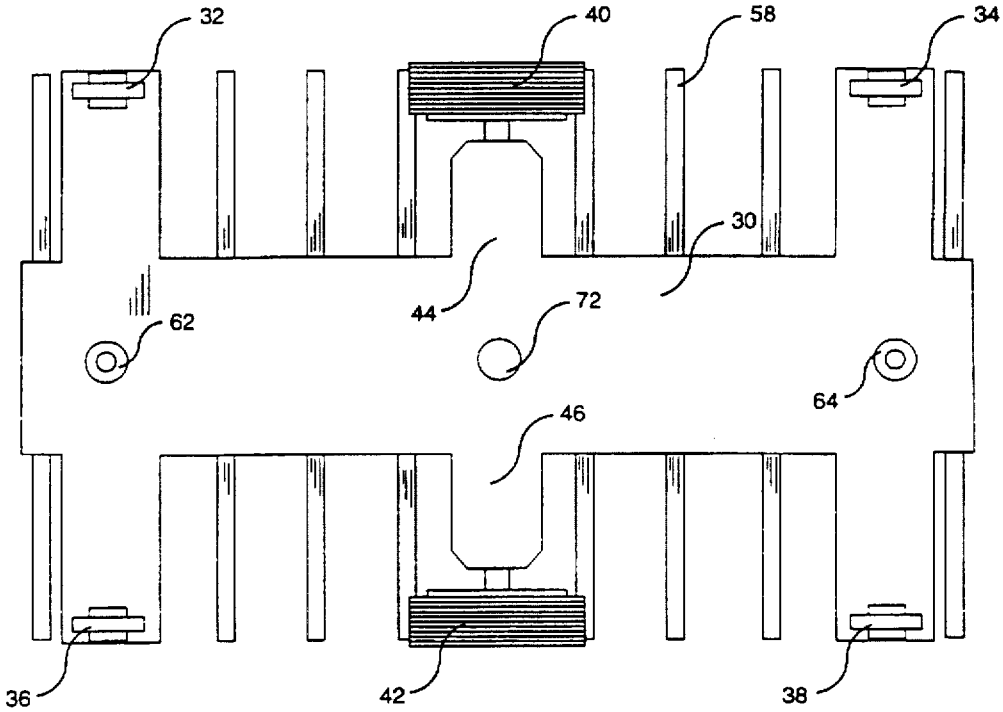
FIG. 3 represents a view from beneath a trolley used in the installation of this invention.
Figure 4:
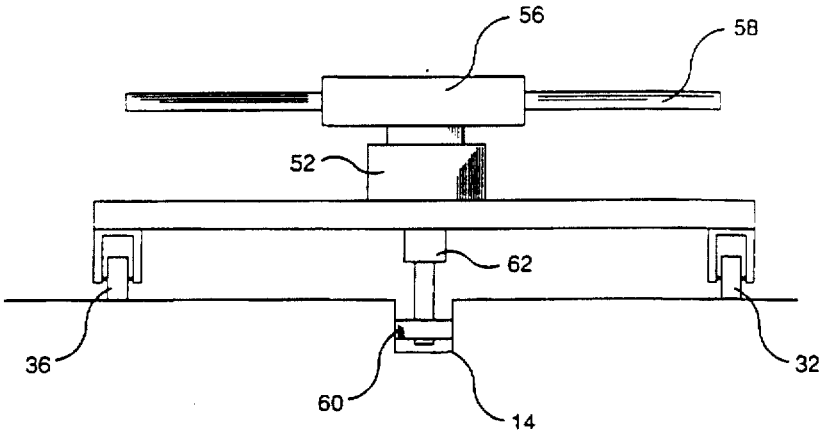
FIG. 4 is a schematic view of the front of a trolley with its mobile part in the lower position.

The transporting trolleys for motor cars are schematically represented in FIGS. 2, 3 and 4. As illustrated in FIG. 2, which shows the side view of a trolley, each trolley comprises a frame (30) supported by four bearing, idle wheels; two of these, wheels (32) and (34), are shown in FIG. 2. The study of FIG. 3, representing the under view of a trolley, reveals the frame (30) with a peculiar shape, displaying a narrow central part and four side-members, each bearing the four idle wheels (32), (34), (36) and (38).

The trolley also features two driving-wheels (40) and (42) mounted on the axles (44) and (46). The driving-wheels (40) and (42) are activated in a forward or backward rotation by means of the engine (48).

The trolley also includes a mobile stand (50) supported by two jacks (52) and (54), vertically erected on the frame (30). As more clearly depicted in FIG. 4, representing the front view of the trolley, this mobile stand is constituted of a longitudinal, central structure (56) and two series of horizontal bars (58), parallel and at a distance from each other, orthogonally stretching each side of the central structure (56).

The trolley is also fitted, under the front and rear parts of the frame (30), with a rubber guiding roller (60) designed to slide within the guiding rail (14) or (16) (see FIG. 1). The guiding roller (60) is operated by the jacks (62) or (64). When the trolley is moved by the driving-wheels (40) and (42) activated by the engine (48), it remains at the centre of the runway thanks to the guiding roller (60) which is in its lower position in the guiding rail (14) or (16). When the trolley arrives in front of the storage cell and is pivoted, the guiding rollers are retracted above floor level using jacks (62) and (64), so that the trolley can be slewed. Once the slewing motion is completed, when the trolley is aligned with the axis of the cell, the guiding rollers are set back down in the guiding rails of the cell, as for example rail (28) in FIG. 1, to enable the forward or backward movement of the trolley within one of the cells.

The loading and unloading system of the invention is identical to that described in the French Patent 90/15547. In this system, each storage cell represented in FIG. 5 by the space between the partitions (66) and (68), as well as each elevator whenever necessary (except when the car park is only single story) are fitted with two fixed racks (70) and (70') secured on the inner faces of the partitions and facing each other, constituted of horizontal, fixed bars, parallel and at a distance from each other. These racks are designed to delimit, between the ends of the bars, a free central space with a width greater than that of the trolley's central structure (56).

If the car park is only single story, an entry lock must still be provided, with bars identical to bars (70) and (70'). Either in the case of an elevator or that of a mere entry lock, an access ramp must be provided at the level of the bars, in order to bring the vehicle forward in a suitable position.

Figure 5:
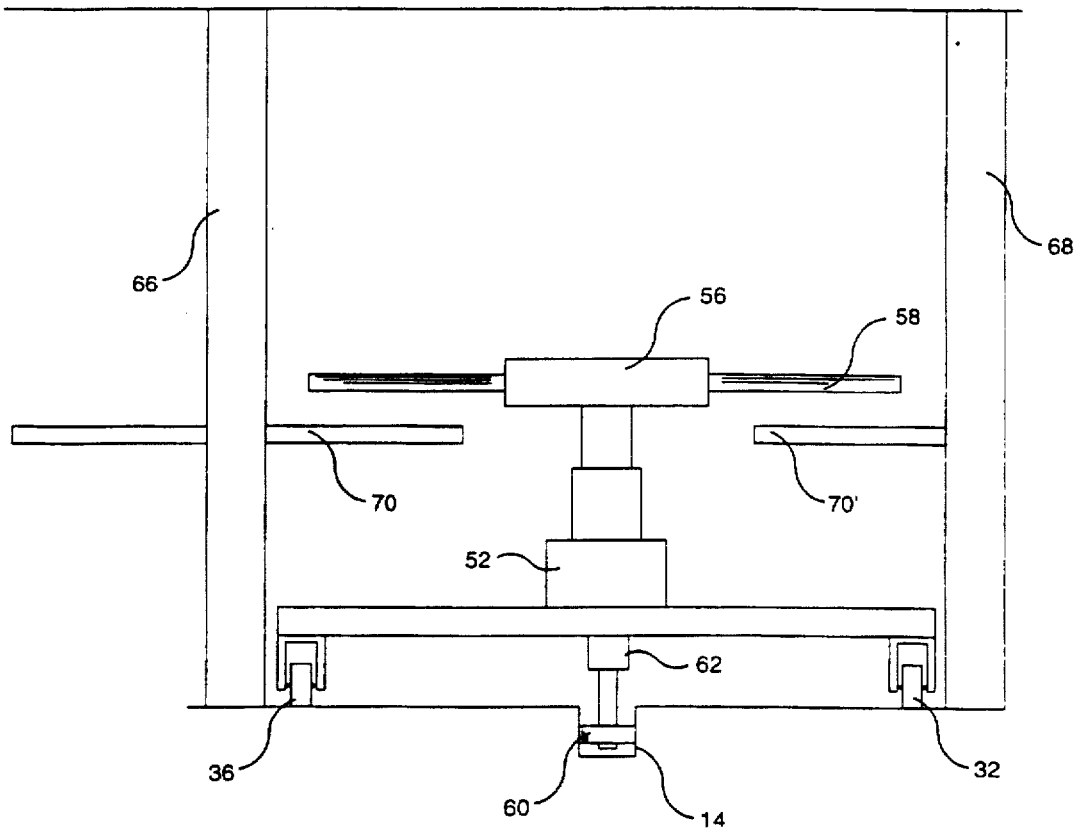
FIG. 5 is a schematic view of the front of a trolley inside a storage cell, with its mobile part in the upper position.

The motor car appearing at the entrance of either the entry lock or the elevator, is placed onto the bars (70) and (70') of the racks. Then, the mobile part of the trolley including the structure (56) and the bars (58) is lifted up to its upper position as shown in FIG. 5 so that the bars (58), taking the place of the bars (70) and (70'), raise the motor car by means of the jack (52). The trolley is then brought out of the lock or the elevator in order to be sent to the appropriate cell. It is generally preferable to lower the mobile part of the trolley to its lower position, as shown in FIG. 2 where the vehicle is depicted by a dotted line, for stability reasons. However, this is not compulsory and the trolley can remain in the upper position.

When the trolley arrives in front of the selected cell, the mobile part of the trolley (and the transported vehicle) is again raised to the upper position if it was in the lower one and the trolley is compelled to revolve so that the guiding roller is inserted into the guiding rail of the cell. It is then moved towards the back of the cell, up to its unloading position. The mobile part is lowered again so that the vehicle is now supported by the bars (70) and (70') secured to the cell's partitions, since the bars (58) of the trolley, passing through the bars (70) and (70'), are at a level below that of the latter.

The installation obviously includes detection equipment such as transmitting-receiving cells designed to:

1) stop the trolley when it arrives at the intersection of the guiding rails of the runway and of the cell;
2) direct the rotation of the trolley up to its alignment with the guiding rail of the storage cell;
3) direct the lifting of the mobile part of the trolley;
4) stop the trolley when it arrives at the intended position within the cell;
5) direct the lowering of the mobile part of the trolley;
6) stop the trolley when it arrives again at the intersection of the guiding rails;
7) direct the rotation of the trolley up to its alignment with the guiding rail of the runway.

All the transmitting-receiving cells in the car park are controlled by a programmed, central managing unit. There may be one managing unit for each story of the installation, or one managing unit for a certain number of vehicles (for example, 40 vehicles), or even a single central unit for the entire installation. The function of the managing unit, which can be a minicomputer, consists of actuating the trolleys when required and directing the transmitting-receiving cells relevant to the storage cell in which a vehicle has to be loaded or unloaded. Most of the trolley's movements are directly prompted from the trolley itself, i.e. the tensioning of the jacks, the pivoting motions, the displacement back or forth. In fact, all these movements follow each other as soon as the previous movement is completed.

The loading operations are controlled in the same way by the transmitting-receiving cells and are very much like the operations described above, except that the mobile part of the trolley must enter the storage cell in its lower position so that the bars (58) are at a lower level than the bars (70) and (70') of the cell supporting the vehicle to be loaded.

Thanks to the transmitting-receiving cells, the central unit can also manage the occupancy of the storage cells. Thus, the managing unit can detect the empty cells to be allocated and, what is more, the cell the closest to the entry-exit in order to minimize the vehicle's entrance or exiting time.

In one particular method, a central managing unit can be designed to control the general management of the car park as well as the in and out-goings of vehicles, connected to sectional computers in charge of about forty storage cells, for the control of the unloading operations in the storage cells or their withdrawal from these.

The essential characteristic of the invention is now described with reference to FIGS. 6 and 7. As already mentioned, each trolley is fitted with a pivoting element located at its centre. This pivoting element (72), schematically represented by a circle in FIG. 6, as well as in FIG. 3, is a cylindrical element activated by a jack (not represented)

so that it can be retracted into its upper position or, on the contrary, lowered to bear on the floor.

When the trolley arrives at a location so that its centre is plumb with the intersection of the runway's guiding rail (14) and the cell's guiding rail (28), it is automatically detected by a perception device such as the cell previously mentioned and it is stopped. The jack is tensioned and lowers the pivoting element down to the floor. The lower part of this element could, for example, have a diameter greater than the width of the rail and its extremity could be conical, so that the element becomes slightly wedged in the intersection point of both rails. The trolley being thus fixed to the floor, its engine is then switched on to prompt the forward rotation of the right wheel (40) and the backward rotation of the left wheel (42). This driving of both wheels in opposite directions results in the slewing of the trolley to the left, as shown by the arrows in FIG. 6. This slewing motion goes on until the trolley reaches the position shown in dotted lines on the figure, i.e. when the trolley's axis coincides with the guiding rail (28) of the cell.

Although a slewing motion by means of the method described above is preferable when implementing the invention, other means can obviously be used to carry out this rotation as long as they contribute to achieving the rotation of the trolley in a similar fashion.

Although the cells form an angle of 45° with the runway in the preferred solution of implementation of the invention, it is possible to resort to a more acute angle, for example 35°, or a wider angle, such as 55°. However, the angle of 45° is optimal since it ensures the best ratio in terms of number of parking bays in relation to the floor area.

Figure 6:
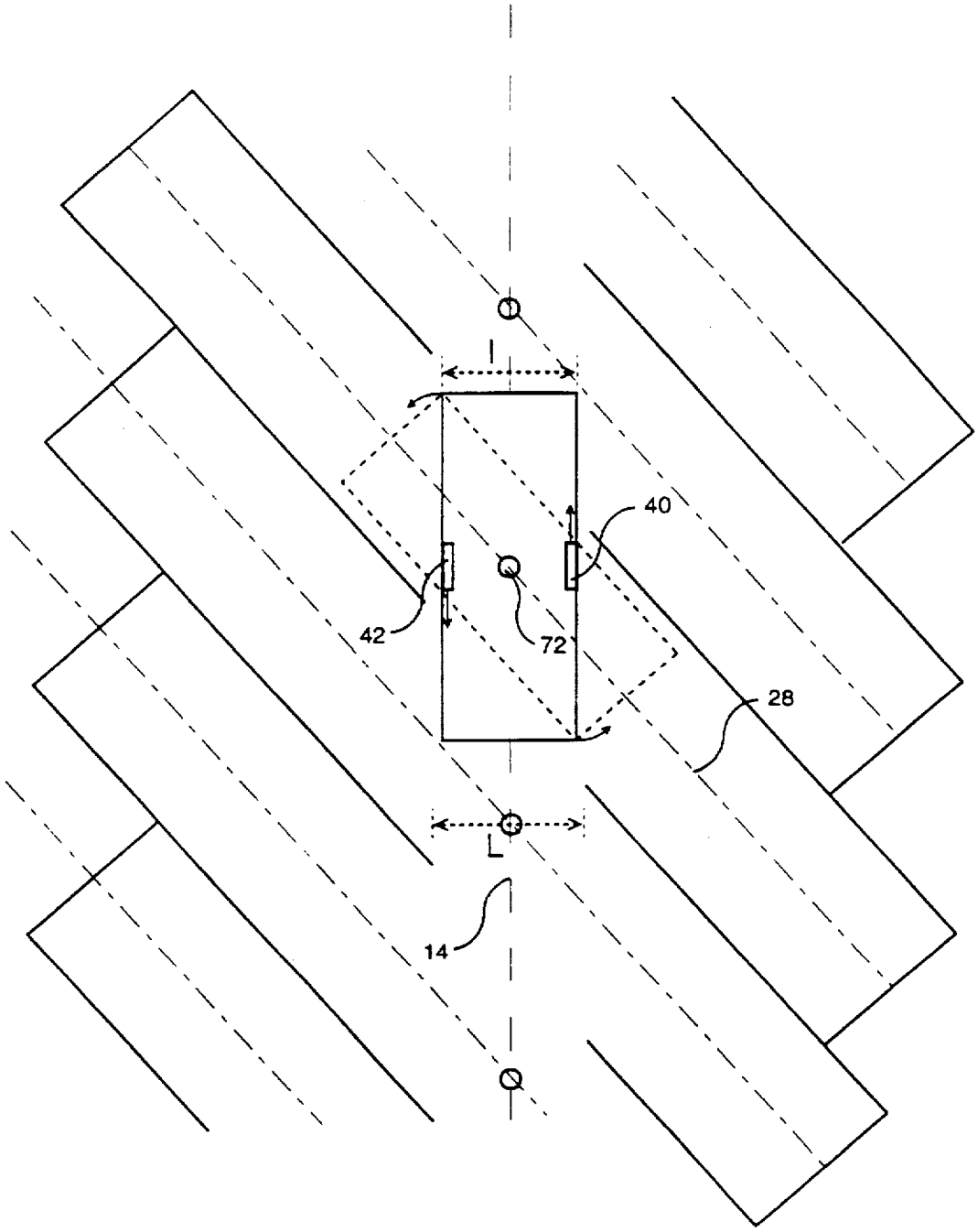
FIG. 6 schematically depicts the pivoting motion carried out by a trolley prior to entering a storage cell and FIG. 7 demonstrates the advantage of the pivoting motion of a trolley used in the installation of this invention, in comparison to the movement of a trolley following the previous technique.
Figure 7:
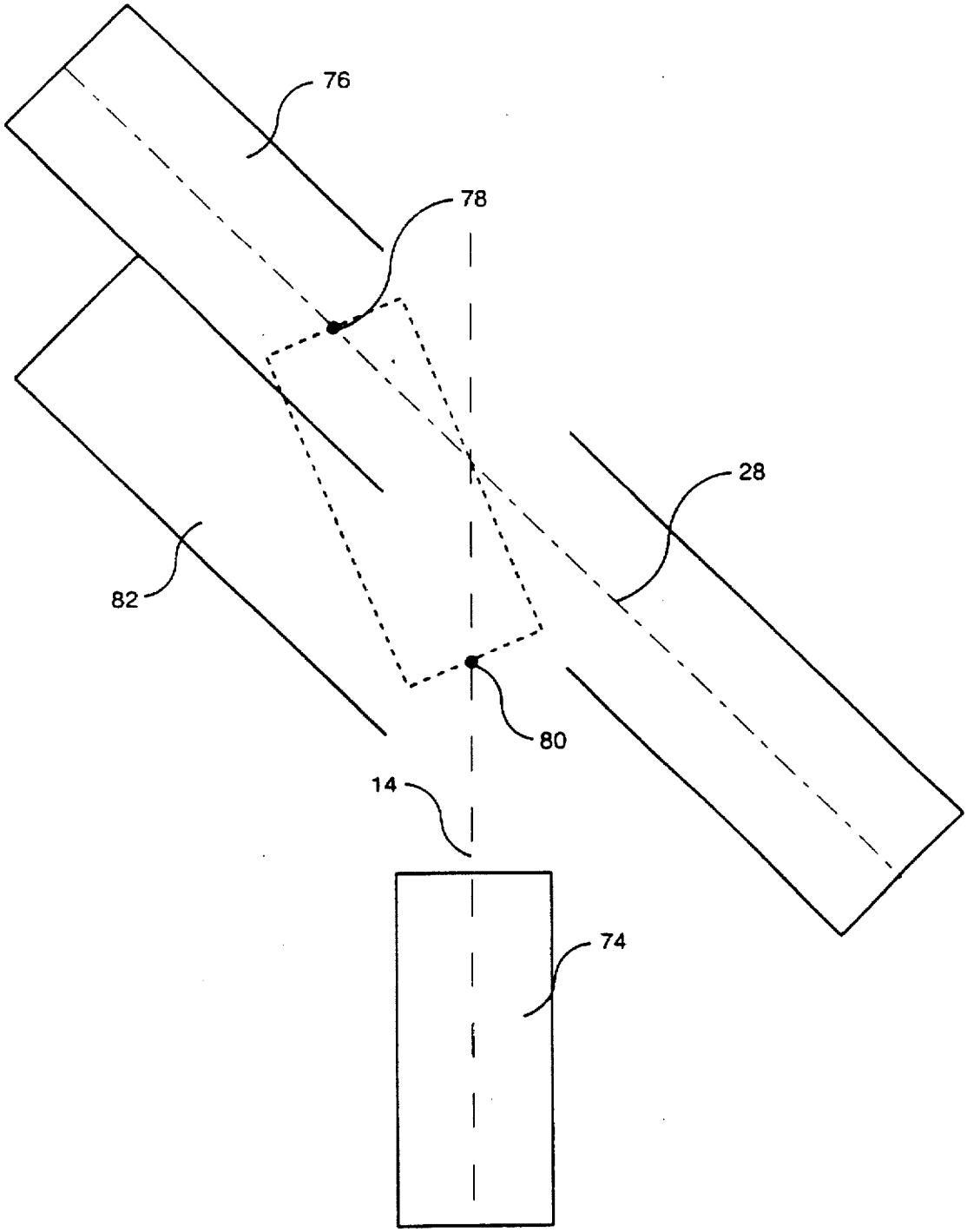

In fact, in the preferred solution of implementation using the 45° angle, FIG. 6 clearly shows that the cell partitions can delimit a runway with a minimum width without hindering the rotation of the trolley. Thus, the width L of the runway necessary for a trolley whose width I is 2.50 m, enabling the transfer of any motor car, needs only be about 2.70 m. Furthermore, the wasted area at the end of the cells is not significant.

If an angle below 45° is used, for example 30°, the width of the runway remains minimum but the wasted area is increased, due to the slant. On the contrary, if an angle greater than 45° is used, for example 60°, the wasted area is smaller along the cells' length but the runway must have a width L greater than that of the trolleys so as not to prevent them from pivoting. In the latter case, the cell partitions must not be too close to the runway, since the trolley's length is more than twice its width, for example 5.50 m to allow the transportation of any kind of motor car.

The essential characteristic of the invention, i.e. to pivot the trolley so it can enter the cell, presents a considerable improvement compared to the technique described in the French Patent 90/15547, which consisted of steering the trolley by turning the front wheels. This is illustrated in FIG. 7, in which a trolley (74) moving along the runway represented by the guiding rail must go and unload a motor car in the cell (76). In the installation complying with the invention, the trolley proceeds normally until its centre, fitted with the pivoting element, is located at the intersection point of the guiding rail (14) and the guiding rail (28) of the cell (76). Assuming that the trolley was steered by its front wheels, it would be brought into the position illustrated by the dotted lines in the figure: its front guiding roller (78) would be engaged in the guiding rail (28) while its rear guiding roller (80) would still be engaged in the guiding rail (14). As shown in the figure, part of the trolley would find itself in the cell (82), adjacent to the cell (76). This is obviously impossible, taking into account the partition between the cells (76) and (82), which would prevent the progress of the trolley. Therefore, to enable the use of this type of trolley, the distance between the runway and the cells would have to be far greater, about 4 m instead of less than 1.50 m with the invention.

The structural possibility resulting from the invention, i.e. requiring a runway of a mere 2.50 m to 2.70 m wide, also allows the columns supporting the building to be closer to each other and therefore able to withstand 15 to 16 times more weight than a traditional car park, where the columns are 10 m apart.

The installation which is described above includes two independent runways, served by two trolleys and two elevators or hoists if the installation involves several stories, or two entry locks if the installation involves a single story. In fact, the installation can be carried out in a different way. As a matter of fact, since the trolley can be pivoted around its centre and achieve a 180° angle or even a full revolution, there could be only one rectangular shape runway, serving all the storage cells. In this case, a single trolley may be used, although this solution would prove ineffective.

Still due to the pivoting capacity of the trolley, the entry lock(s) (or elevators) could be arranged at right angles to the runways; this would obviously necessitate the rotation of the trolley after loading the vehicle. In the same line of thought, a single entry lock or elevator could serve the two runways represented in FIG. 1.

However, the optimal installation ensuring a fast loading and unloading of vehicles is the installation which includes two entry or exit locks (or two elevators if it involves more than one story) and two trolleys. While one vehicle is retrieved from one of the locks (known as the exit lock), a second vehicle enters the other lock (known as the entry lock), a third vehicle is being loaded in a storage cell using the first trolley and a fourth vehicle is being unloaded from another cell using the second trolley.

The car park arrangement illustrated in FIG. 1, in which pairs of storage cells are facing each other across each side of the runway, allows for a single guiding rail for at least two cells (four cells in the installation illustrated in FIG. 1). Furthermore, this arrangement enables the trolley to be used to unload a vehicle in one storage cell, then to fetch the vehicle in the opposite cell, without having to be pivoted.

The installation described above may comprise about forty vehicles only per story: this would allow the managing system to be rationalized. Such "mini car parks", whose management would be carried out by independent computers, could be longitudinally or transversely juxtaposed, thus permitting, in the case of an incident, the replacement of a trolley from one story by the trolley of the adjacent mini car park, or the exit of the vehicles through the adjacent mini car park. It would also be possible to provide entrances and exits along a track, at about 50 m intervals, to permit users to park close to their intended destination.

Although the invention has been described according to the preferred implementation method for storing motor cars, it can also be used for stocking other objects, such as merchandise. It could be used for goods transported in containers by truck, freight car, ship . . . . In this case, intermediate vehicles fitted with racks (70) and (70') (see FIG. 5) must be provided; the containers to be stored are placed on the racks, which can be lifted using jacks fixed on the intermediate vehicle. When they arrive at the entrance to the mechanized installation now acting as a warehouse, the jacks have simply to be tensioned to lift the containers so the trolley and its spaced, parallel bars (58) (see FIGS. 4 and 5)

can be introduced under the racks (70) and (70') of the intermediate vehicle in its upper position. The final stage of the manoeuvre is identical to that previously described when the invention is used for the parking of motor cars. Of course, when trucks are used for transport, the intermediate vehicles are not compulsory, as the system using jacks and racks can be directly installed on the trucks. In any case, it is necessary to provide loading and unloading bays at the entrance to the installation so that the transporting trolley is level with the trucks or intermediate vehicles, or preferably with the hoists which are positioned at the level of the trucks or intermediate vehicles and which can be used either to take or retrieve the containers using the trolley, or to serve the different storage storys (including the ground floor). One should also bear in mind that the jacks are not indispensable if fixed racks are installed at a certain level—ensuring the trolley's travel—on the inner sides of the intermediate vehicles. However, this arrangement is not advantageous, since it reduces the loading capacity of the intermediate vehicle.

The above mentioned application could prove very useful when the goods to be stored are brought by road or railway into warehouses located in the center of large cities.

I claim:

1. Mechanized and automatically arranged installation for the storage of objects in storage cells comprising a floor having a groove, a central managing unit, at least one runway having an axis of symmetry, a plurality of storage cells each having an axis of symmetry and being distributed on sides of the runway, a trolley comprising a frame having a front and a rear and mounted on drivable wheels and having guiding rollers at the front and rear adapted to slide in the groove, driving means for driving said wheels, said trolley also having a gripper for holding and loading or unloading an object on the trolley, each storage cell having a pair of longitudinal fixed racks comprising horizontal, fixed bars, parallel and at a distance from each other and adapted to cooperate with said gripper, said installation further comprising said storage cells being longitudinally oriented, forming an angle of at least 30° with said runway, and said trolley having a pivot movable between a first position and a second position and also rotatable to pivot the trolley around an intersection point of the symmetry axis of the runway and the symmetry axis of a cell in which the object is to be loaded or unloaded in order to align the guiding rollers along one or the other of the symmetry axes, said first position being in contact with the floor and said second position being out of contact with the floor.

2. Installation according to claim 1, in which said storage cells are longitudinally orientated, forming an angle of 30° to 60° with said runway.

3. Installation according to claim 1, in which said trolley (18), (22) is fitted with four bearing, idle wheels (32), (34), (36) and (38) and two driving-wheels (40), (42) mounted on an axle (44) roughly located at a middle of said trolley and the rotation of which is activated by an engine (48) adapted to pivot said trolley by prompting one of said driving wheels in one way and the other wheel in the other way.

4. Installation according to claim 3, in which said storage cells (24), (26) are arranged at an angle of about 45° with said runway (14), (16).

5. Installation according to claim 1, in which said storage cells (24), (26) are coupled and face each other on each side of said runway (14), (16), sharing the same symmetry axis so that said trolley can unload an object in one of the couple of cells and then load another object located in the other of said cells, without having to carry out an intermediate rotation.

6. Installation according to claim 1, adapted for the object being a motor car, additionally including an entry lock having partitions with two fixed racks identical to said racks fitting each of said storage cells, secured to the inner sides of the partitions of said entry lock and level with the cat's entry bay, so that a vehicle arriving at the entrance to said lock can be placed onto said racks, in order for said trolley to be able to grip said vehicle after it enters said entry lock.

7. Installation according to claim 1 adapted for the object being a storage container, having an intermediate, liftable transport vehicle for transferring a container in said installation, and having two fixed racks identical to said racks attached to each of said storage cells, and adapted to support said container and to be lifted, so that, when said intermediate vehicle arrives at the entrance to said installation, said trolley can use said racks to grip each of said containers.

8. Installation according to claim 1, in which said gripper includes:

a mobile part borne by the frame (30) of the trolleys (18), (22) and comprising a longitudinal, central structure (56) with a width smaller than that of the central area provided between the two fixed racks (70) and (70'), as well as two series of horizontal bars (58), parallel and at a distance from each other, orthogonally stretching each side of said central structure, a vertical displacing means (52) for the mobile part, borne by said frame, and adapted to displace said mobile part when said trolley is located within a storage cell, between a lower position, where this mobile part is below the level of the fixed racks and a upper position, where it is above the level of the fixed racks.

9. An installation according to claim 1 including a jack adapted to move the pivot between the first and second positions.

10. Installation according to claim 9, in which said pivot is of a vertical element (72) mounted on the jack, adapted to be in the second position when said trolley is in motion and in the first position to bear on the floor at the axes intersection point of the runway and the storage cell, prior to proceeding with the pivoting of said trolley.

* * * * *